United States Patent [19]

Smick

[11] 4,137,744

[45] Feb. 6, 1979

[54] APPARATUS FOR FORMING TURBULATORS

[76] Inventor: Ronald H. Smick, 745 Chapel St., Ottawa, Ill. 61350

[21] Appl. No.: 813,676

[22] Filed: Jul. 7, 1977

[51] Int. Cl.[2] ..... B21H 8/02; B21D 13/10; 242 78.6

[52] U.S. Cl. ..... 72/196; 242/78.6

[58] Field of Search ..... 72/196, DIG. 16; 113/1 C; 138/38; 110/97 D

[56] References Cited

U.S. PATENT DOCUMENTS

| | | | |
|---|---|---|---|
| 448,073 | 3/1891 | Price | 72/196 |
| 1,365,258 | 1/1921 | Lundin | 72/196 |
| 1,536,897 | 5/1925 | Loafea | 72/196 |
| 2,660,198 | 11/1953 | Morrow | 138/38 |
| 3,834,204 | 9/1974 | Ihle | 242/78.6 |

*Primary Examiner*—Lowell A. Larson

*Attorney, Agent, or Firm*—Leydig, Voit, Osann, Mayer & Holt, Ltd.

[57] ABSTRACT

An apparatus for forming heat exchanger turbulators from a roll of sheet metal strip stock employs two forming wheels with generally triangularly shaped teeth meshing with one another and one roll being driven about a fixed axis and the other roll being journalled on a second axis parallel to the first and disposed in floating relation thereto with means for adjustably biasing the second roll toward the first. A special tooth on each roll is used to form the turbulator handle and cut-off blades may be included to automatically cut the formed strip into individual turbulators.

9 Claims, 5 Drawing Figures

14
35
59
57
56
58
55
60
76
75
77
61
15
34
54
4

APPARATUS FOR FORMING TURBULATORS

The present invention relates generally to apparatus for forming sheet metal and more particularly concerns methods and apparatus for forming narrow rolls of strip sheet metal stock into improved turbulators as disclosed in my copending application Ser. No. 656,329, filed Feb. 9, 1976, now U.S. Pat. No. 4,044,796, the subject matter of which is incorporated herein by reference.

In the past many different forms of turbulators have been proposed and patented as indicated in the specification of the above-mentioned application Ser. No. 656,329. Of these the most commercially successful has probably been a modified "Brock" type as disclosed in Brock Pat. No. 2,591,398 FIG. 4 and Wilson patent No. 3,185,143 FIGS. 1, 3 and 4, wherein the width of the turbulator is made narrower than (perhaps only one-half as wide as) is shown in these patents. As will be appreciated by those skilled in the art these modified "Brock" turbulators have deflection panels which alternately angle back and forth across the inside of a heat exchanger conduit while each panel is tilted to direct the flow of heat exchanger fluid downwardly against the lower half of the conduit.

It will also be seen by reference to the above-mentioned figures of the Brock and Wilson patents that there is a single bend in these modified turbulators between alternating deflection panels. Thus, as these turbulators are formed from previously cut short strips of material, the free end of the strip material must alternately swing back and forth through the angle of the bend as each bend is made. As a consequence, it has been customary, if not a necessity, to form these modified "Brock" turbulators in hand forming brakes wherein each intended bend is first sequentially registered in the brake by hand and then the bend is hand formed. While this hand forming operation is inherently slow, it has had the virtue that the side-to-side swinging of the free end of the strip material could be controlled or, at least, tolerated within acceptable limits.

It is the primary aim of the present invention to provide an apparatus for forming improved turbulators on a continuous automated forming machine. A more particular object is to provide such apparatus wherein two offsetting bends are simultaneously formed in the turbulator strip material so that neither end of the turbulator has any appreciable tendency to swing back and forth during the forming operation.

Another object of the invention is to provide for an automated rotary apparatus for forming improved turbulators of the type disclosed in my above-mentioned copending application. It is a more detailed object to provide for such apparatus including provision for automatic strip decurling and roll end shut-off as well as provisions for varying the strip forming pressure and the width of the strip material which can be accommodated.

These and other objects and advantages of the present invention will become more readily apparent upon reading the following detailed description and upon reference to the accompanying drawings in which.

While the present invention will be described in connection with certain preferred embodiments and procedures, it will be understood that I do not intend to limit the invention to those particular embodiments or procedures. On the contrary, I intend to cover all alternatives, modifications and equivalents as may be included within the spirit and scope of the invention as defined by the appended claims.

Figure 1:
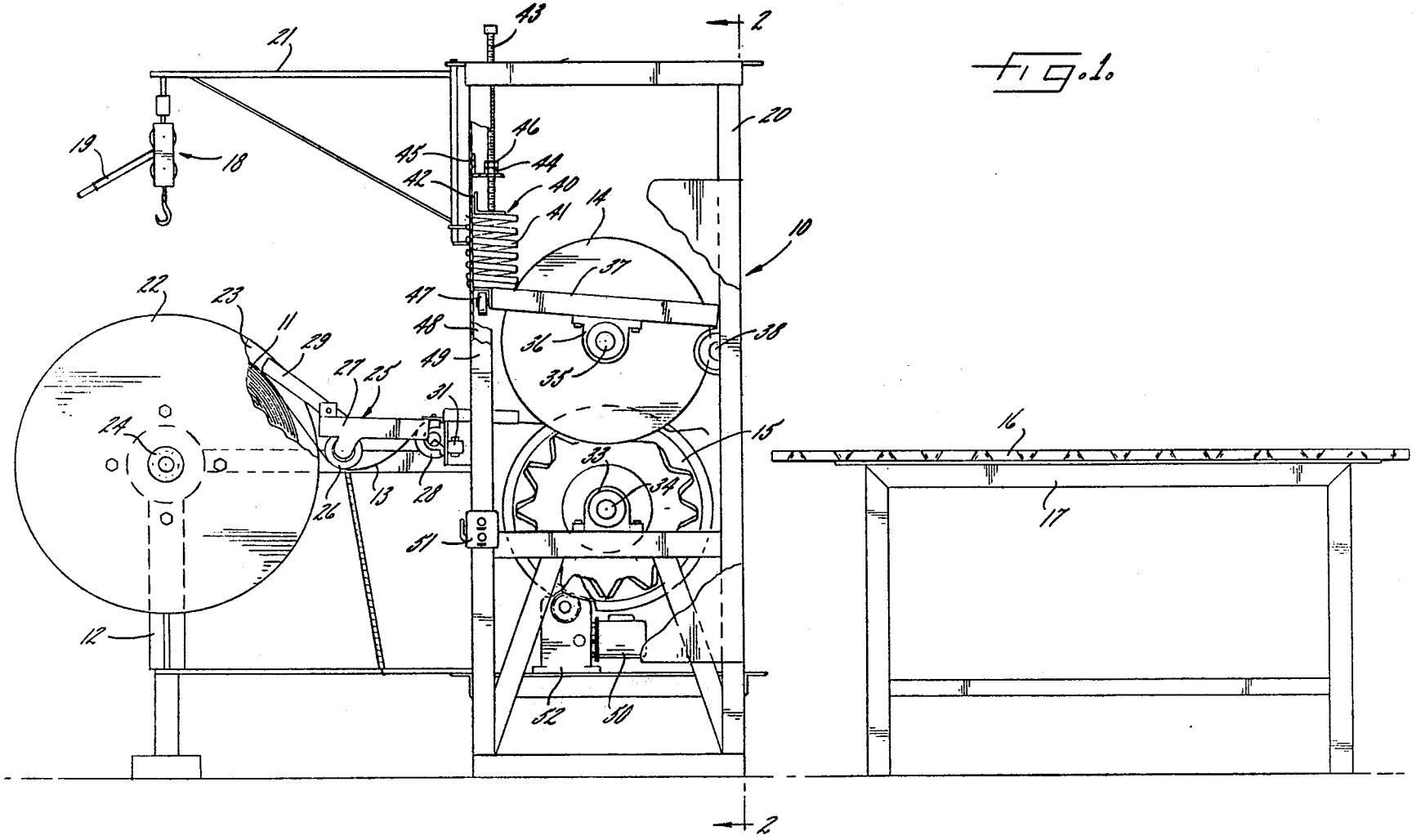
FIG. 1 is a side elevation, with certain parts cut away, of the apparatus for forming the improved turbulators of the present invention.

Turning now to the drawings, there is shown in FIG. 1 an apparatus 10 for forming improved turbulators according to the method of the present invention. A roll of strip sheet metal material 11 is supported on a standard 12 with a strip 13 of the material being fed between upper and lower forming rolls 14 and 15 of the apparatus 10. As will be more particularly described below, each revolution of the forming rolls 14 and 15 produces a turbulator 16 of the type disclosed and described in my above-mentioned application Ser. No. 656,329. Each emerging turbulator 16 that is formed by the apparatus 10 is separated (for example by shearing it) from the next formed turbulator and is preferably stacked on a suitable table or stand 17. Subsequently, the turbulators 16 may be conveniently consolidated into groups of ten or so and banded together for shipment as such or for placement with similarly banded bundles on an appropriate shipping pallet.

To facilitate placement of the roll of strip material 11 on the standard 12, the apparatus 10 is desirably provided with a lift mechanism 18. As shown in the illustrated embodiment of FIG. 1, the lift mechanism 18 is in the form of a block and tackle operated by a ratchet engageable handle 19. In the preferred embodiment, the lift mechanism 18 is pivotally attached to the frame 20 of the apparatus 10 in cantilever relationship by a subframe 21. Thus, the roll or coil 11 is raised by the lift 18 and placed on the standard 12. Preferably, the coil 11 is retained between side plates 22 and 23 journalled on a shaft 24 supported on the standard 12.

To take the curl out of the strip stock material as it is unwound from the coil 11, the strip 13 is drawn through a reverse bending or decurling mechanism 25. As shown in FIG. 1, the mechanism 25 includes a decurler roll 26 journalled on a pivotally mounted arm 27 and a re-bend roll 28 journalled on the frame 20. Secured to the arm 27 is a follower 29 which rides on the surface of the coil 11 as the arm 27 is biased downwardly by a spring 30. Thus, as the diameter of the coil 11 decreases and the roll curvature increases, the amount of decurling is automatically increased by lowering the position of the decurler roll 26. The follower 29 is dimensioned so that when the roll 11 is depleted, the follower swings down and the arm 27 engages a limit switch 31 which turns off the forming machine 10.

In accordance with the present invention, the lower forming roll 15 is journalled by bearing blocks 33 (only one of which is shown) mounted on the frame 20 such that the forming wheel 15 rotates in a plane perpendicular to a first axis defined by a shaft 34. Means are provided for mounting the upper forming roll 14 in floating relation to the lower roll 15. As shown in FIG. 1, the upper roll 14 is carried on a shaft 35 parallel to the lower shaft 34. The upper shaft 35 is journalled in bearing blocks 36 (only one of which is shown) carried on a subframe 37 pivotally mounted at 38 so the upper forming roll 14 may move toward and away from the lower roll 15.

Biasing means 40 are provided for urging the upper roll 14 into engagement with the lower roll 15. In the illustrated embodiment, the biasing means 40 includes a pair of heavy compression springs 41 which engage the free end of the subframe 37. An angle member 42 bridges the upper ends of the springs 41 and is adjustably positioned by a pair of threaded bolts 43. Each of the bolts 43 is received in a nut 44 welded to a cross piece 45 of the frame 20 and preferably a lock nut 46 is tightened against the fixed nut 44. It will be appreciated that as the bolts 43 are screwed into the nuts 44 the compression of the springs 41 is increased. Preferably the free end of the subframe 37 is guided by rollers 47 which engage the inner surface of the vertical side rails 48 and 49 of the frame 20.

To rotate the forming rolls 14, 15 a suitable power source such as an electric motor 50 is provided. The motor 50 is controlled by a start-stop switch 51 wired in series with the shut-off switch 31. The motor 50 preferably is connected to a gear reduction unit 52 having an output gear 53 that meshes with a gear 54 secured to the lower shaft 34. With a normal motor speed of 1725 rpm, the gear reduction unit 52 and final gear set 53, 54 may provide for a running speed on the order of 6.5 rpm for the forming roll 15.

Figures 3, 4:
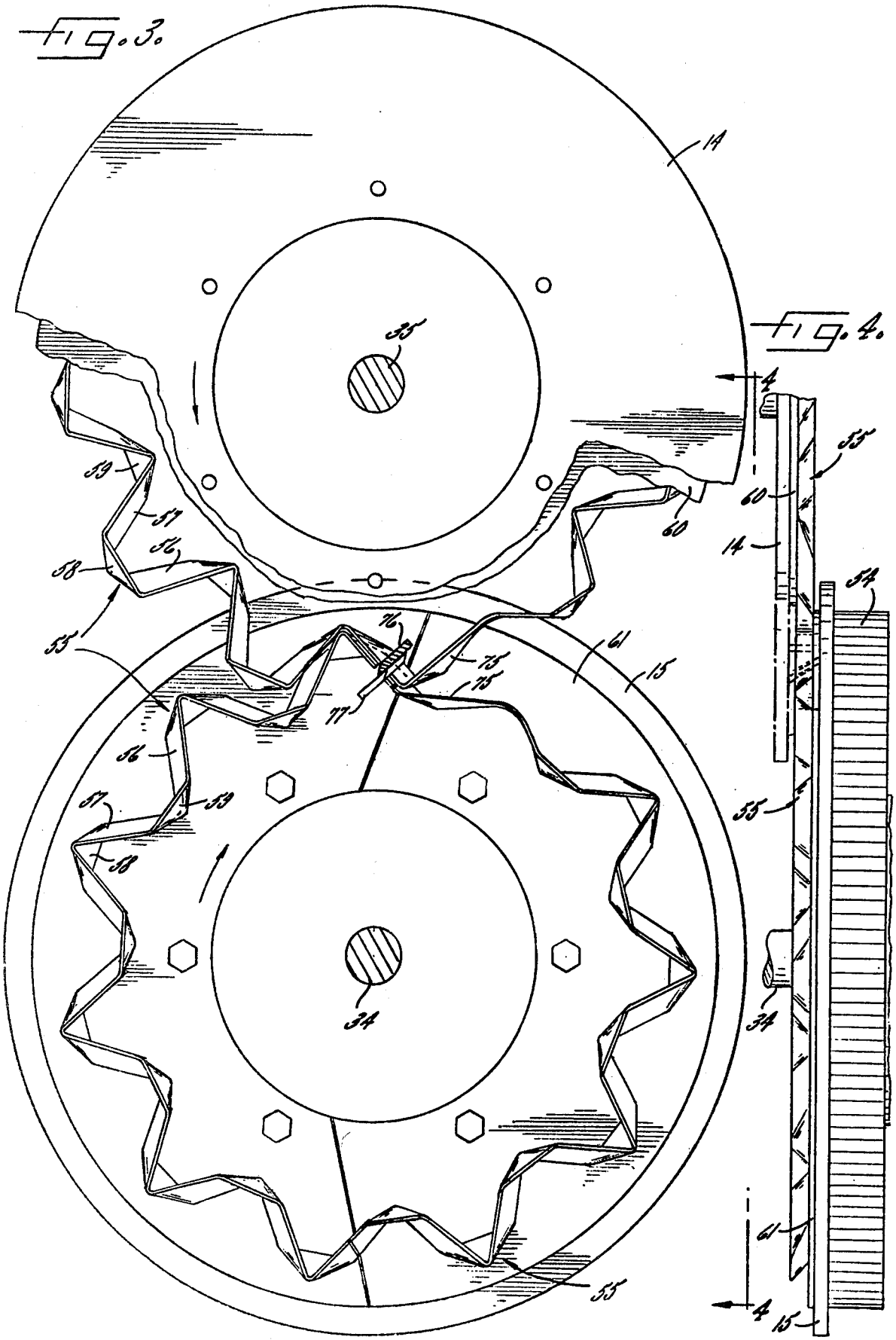
FIG. 3 is an enlarged fragmentary side elevation view of the rotary forming wheels shown in FIG. 1.
FIG. 4 is a partial front elevational view, taken substantially along line 4—4 in FIG. 3; and, FIG. 5 is an enlarged partial plan view of one of the turbulators formed in accordance with the method and apparatus of the present invention.

Pursuant to the present invention, the forming rolls 14, 15 are provided with a plurality of outwardly projecting teeth 55 of generally triangular configuration with two legs 56 and 57 interconnected by a truncated apex portion 58. As shown in FIG. 3, the legs 56, 57 of adjacent teeth 55 are connected by truncated valley portions 59 and the legs 56, 57 are substantially equally oppositely inclined with respect to the plane of the forming rolls 14, 15. It will also be seen that the truncated apex and valley portions 58 and 59 are also oppositely inclined with respect to the plane of the rolls 14, 15.

In the illustrated embodiment, the teeth 55 are actually formed in the shape of a turbulator 16 from stainless steel strip stock, for example, and then drawn into a circle and welded to upper and lower face plates 60 and 61, respectively. Preferably, the face plates 60 and 61 are formed of two generally semi-circular pieces which may then be bolted on the forming wheels 14 and 15 without requiring removal of the shafts 34 and 35 from their respective bearings 33 and 36. It will be appreciated, of course, that the teeth 55 could be machined out of solid stock if desired.

In order to accommodate the strip material 13, the outwardly projecting triangular teeth 55 are formed with a slightly smaller apex angle than the angle of the valley between the teeth 55. It will also be seen upon reference to FIG. 3 that the truncated apex and valley portions 58 and 59 of the teeth 55 are also generally triangular in shape and that the pointed portions of the truncated apexes 58 of each forming wheel 14, 15 force the strip material 13 into the truncated valley portions 59 and against the face plates 60 and 61 of the other wheel. As a result, the tendency of the strip material to slip out from between the teeth 55 is minimized and the face plates 60 and 61 also function as replaceable wear surfaces.

Figure 5:
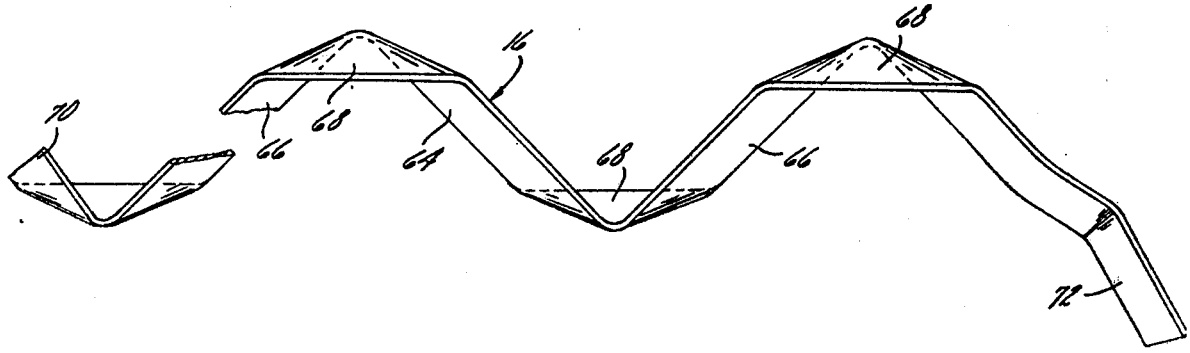

Turning now to FIG. 5, there is shown one of the improved turbulators 16 disclosed in my copending application Ser. No. 656,329, filed Feb. 9, 1976. As described there, the improved turublator 16 is formed from an elongated strip of metal into a series of alternating deflection panels 64 and 66 successively joined together by substantially triangular bridging portions 68. The turbulator 16 may have a partial panel 70 at one end and, preferably, has a projecting handle 72 at the other end. The deflection panels 64, 66 alternately angle back and forth and simultaneously tilt up and down, respectively, relative to the axis of the turbulator 16.

In the embodiment shown in FIG. 5, all of the panels 64, 66 tilt at approximately 45° to the axis of the turbulator 16, it being understood that the panels 64 tilt up and forwardly whereas the panels 66 tilt down and forwardly with respect to the axis. It will also be noted that each of the triangular bridging portions 68 is also tilted about 45° so that its base section is closer to the turbulator axis than its apex. As those skilled in the art will appreciate, it is the formation of these bridging portions 68 which effects the alternate tilting of the panels 64, 66 while they also angle back and forth across the fire tube in this case at an angle of about 45° to the axis of the turbulator.

To form the turbulator handle 72, the forming rolls 14 and 15 are each provided with a special tooth 75 having an obtuse included angle without a truncated bridging section like the other teeth 55. Normally, one turbulator 16 is formed with each revolution of the forming wheels 14, 15 and the leading turbulator is separated from the trailing one such as by shearing them adjacent the handle 72 with cut-off blades 76 and 77 mounted on the respective wheels 14, 15. The turbulators 16 may also be sheared off by hand or cut to different lengths if desired.

In most instances the strip material 13 is hot rolled, mild steel picked and oiled. However, for some applications aluminized steel or other alloy steel may be preferred.

It will also be appreciated that the turbulators 16 may be made of various sizes to fit in different size flue tubes. Thus, for a 1 and 1/4 inch flue tube, the strip material 13 may be ½ inch wide and 0.067–0.069 inch thick strip stock having a Rockwell hardness of B64. For larger flue tubes such as 4 inch diameter, the strip material 13 may be 1 inch wide and 0.090-0.094 inch thick having a Rockwell hardness of B70.

It will be appreciated that a different pair of forming rolls 14 and 15 are used when turbulators of a substantially different dimension are to be made. However, the upper forming roll 14 is laterally adjustable and thus one pair of rolls 14 and 15 can be adjusted to accommodate strip material of slightly differing widths.

Figure 2:
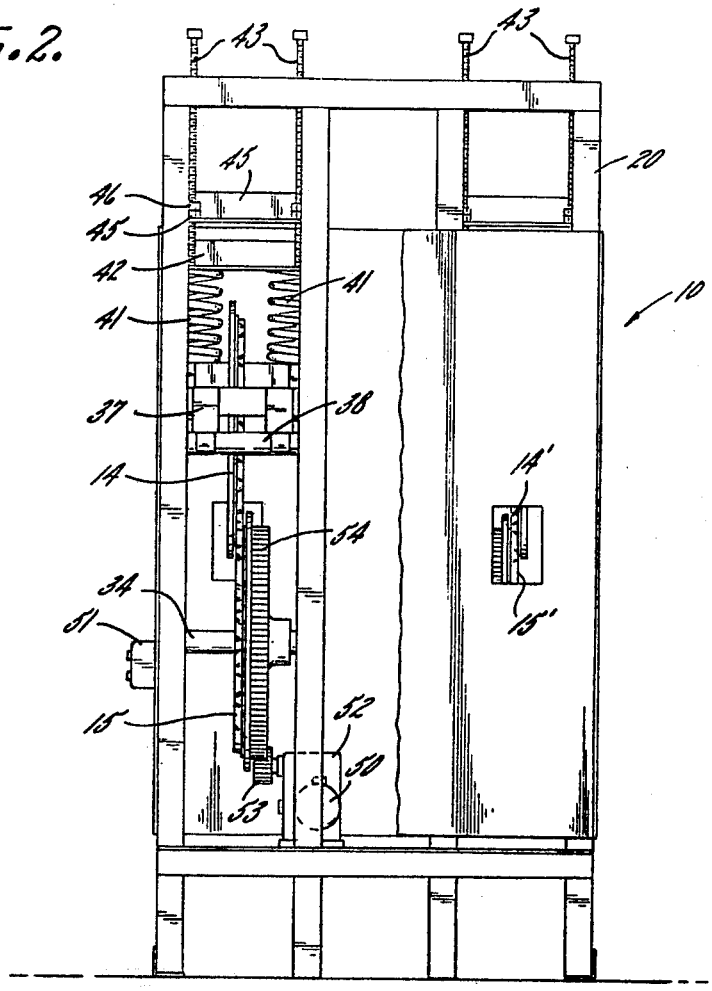
FIG. 2 is a front elevation of the apparatus shown in FIG. 1, taken substantially along line 2—2 in FIG. 1, with certain portions broken away to show the internal parts.

From the foregoing it will be seen that an automatic forming machine 10 is provided for forming turbulators 16 out of a coil 11 of strip stock 13. In the illustrated embodiment, the machine 10 is actually a tandem arrangement with a second set of smaller forming rolls in the right hand portion as seen in FIG. 2.

I claim as my invention:

1. Apparatus for forming a turbulator from a strip of sheet metal stock comprising, in combination, a frame, first and second forming wheels each having a substantially circular face plate, means for journalling said first forming wheel in said frame for rotation in a plane perpendicular to a predetermined axis, means for journalling said second forming wheel in said frame about a second axis substantially parallel to said first axis, each of said forming wheels having a plurality of outwardly projecting teeth of generally triangular configuration with two legs interconnected by a truncated apex portion, said legs of adjacent triangles being connected by a truncated valley portion and being substantially equally oppositely inclined with respect to said plane, means for rotating one of said forming wheels, and means for urging said second forming wheel into tooth meshing engagement with said first forming wheel as said sheet metal strip is fed therethrough, said truncated apex and valley portions also being generally triangular in shape and oppositely inclined with respect to said plane such that the pointed portions of said truncated apexes of each roll force the strip metal into said truncated valley portions and against said face plate of said other roll.

2. Apparatus as defined in claim 1 wherein said second axis is movable toward and away from said first axis and means are provided for biasing said second forming wheel into meshing engagement with said first forming wheel.

3. Apparatus as defined in claim 2 wherein said means for journalling said second forming wheel is mounted on a subframe pivotally mounted for movement toward and away from said first forming wheel.

4. Apparatus as defined in claim 3 wherein said biasing means includes selectively adjustable compression springs.

5. Apparatus as defined in claim 1 wherein said strip material is fed from a continuous roll of strip metal stock and means are provided for reversely curling said strip metal as it leaves said roll.

6. Apparatus as defined in claim 5 wherein said decurling means includes means for sensing the decreasing diameter of said roll and for automatically increasing the reverse curl imparted to said strip metal.

7. Apparatus as defined in claim 6 including shut-off means and wherein said sensing means is effective to trigger said shut-off means upon depletion of said roll.

8. Apparatus as defined in claim 1 wherein said first and second forming wheels respectively include mating apex and valley portions having an obtuse included angle for forming a handle portion of said turbulator.

9. Apparatus as defined in claim 1 including means for adjusting the plane of rotation of said second forming wheel with respect to said first plane so as to accommodate strip material of varying widths.

* * * * *